US008153567B2

(12) United States Patent
Krull et al.

(10) Patent No.: US 8,153,567 B2
(45) Date of Patent: Apr. 10, 2012

(54) MINERAL OILS WHICH COMPRISE DETERGENT ADDITIVES AND HAVE IMPROVED COLD FLOWABILITY

(75) Inventors: Matthias Krull, Harxheim (DE); Robert Janssen, Bad Soden (DE); Werner Reimann, Frankfurt (DE)

(73) Assignee: Clariant Produkte (Deutschland) GmbH, Frankfurt (DE)

( * ) Notice: Subject to any disclaimer, the term of this patent is extended or adjusted under 35 U.S.C. 154(b) by 1078 days.

(21) Appl. No.: 11/644,228

(22) Filed: Dec. 22, 2006

(65) Prior Publication Data

US 2007/0149417 A1 Jun. 28, 2007

(30) Foreign Application Priority Data

Dec. 22, 2005 (DE) ..... 10 2005 061 465
Sep. 28, 2006 (DE) ..... 10 2006 045 813

(51) Int. Cl.
*C10L 1/18* (2006.01)
*C10M 133/56* (2006.01)

(52) U.S. Cl. ..... 508/293; 44/309

(58) Field of Classification Search ..... 508/293; 208/17; 44/309
See application file for complete search history.

(56) References Cited

U.S. PATENT DOCUMENTS

| | | | | |
|---|---|---|---|---|
| 4,211,534 | A | 7/1980 | Feldman | |
| 4,670,516 | A | 6/1987 | Sackmann | |
| 5,186,720 | A | 2/1993 | Feustel | |
| 5,391,632 | A | 2/1995 | Krull | |
| 5,522,906 | A | 6/1996 | Hashimoto | |
| 5,766,273 | A * | 6/1998 | Dralle-Voss et al. | 44/346 |
| 5,958,089 | A | 9/1999 | Dillworth | |
| 6,554,876 | B1 | 4/2003 | Tack | |
| 6,743,266 | B2 * | 6/2004 | DeRosa et al. | 44/391 |
| 2003/0177692 | A1 | 9/2003 | Arters | |
| 2004/0255511 | A1 * | 12/2004 | Krull et al. | 44/389 |
| 2005/0000152 | A1 | 1/2005 | Krull | |
| 2005/0005507 | A1 | 1/2005 | Krull et al. | |

FOREIGN PATENT DOCUMENTS

| | | | |
|---|---|---|---|
| CA | 2017126 | | 11/1990 |
| EP | 1 357 169 | A | 10/2003 |
| GB | 1 059 873 | A | 2/1967 |
| WO | WO 03/042336 | A | 5/2003 |
| WO | WO 2006/124438 | A | 11/2006 |

OTHER PUBLICATIONS

EP Search Report with Written Opinion for Application No. EP 06 02 5303, dated May 15, 2008.

* cited by examiner

*Primary Examiner* — Walter D Griffin
*Assistant Examiner* — Francis C Campanell
(74) *Attorney, Agent, or Firm* — Tod A. Waldrop

(57) ABSTRACT

The invention provides for the use of at least one oil-soluble polyoxyalkylene compound,
this polyoxyalkylene compound being an oil-soluble ester, ether or ether/ester of alkoxylated polyols having at least three repeat alkoxy units derived from alkylene oxides having from 2 to 5 carbon atoms per OH group of the polyol which bears at least two aliphatic hydrocarbon radicals having from 12 to 30 carbon atoms
for improving the response behavior of mineral oil cold flow improvers in middle distillates which comprise at least one ashless, nitrogen-containing detergent additive
which is an oil-soluble amphiphilic compound which comprises at least one alkyl or alkenyl radical which is bonded to a polar group, the alkyl or alkenyl radical comprising from 10 to 500 carbon atoms and the polar group comprising 2 or more nitrogen atoms.

33 Claims, No Drawings

MINERAL OILS WHICH COMPRISE DETERGENT ADDITIVES AND HAVE IMPROVED COLD FLOWABILITY

The present invention relates to the use of polyoxyalkylene compounds for improving the cold flowability of mineral oil distillates comprising detergent additives, and to the additized mineral oil distillates.

The ever greater severity of environmental protection laws entails ever more demanding engine technology to comply with the limiting emission values laid down. However, coverage of engine parts, for example of the valves, with combustion residues changes the characteristics of the engine and leads to increased emissions and also to increased consumption. Detergent additives which remove such deposits and/or prevent their formation are therefore added to motor fuels. They are generally oil-soluble amphiphiles which, in addition to an oil-soluble, thermally stable, hydrophobic radical, contain a polar end group.

On the other hand, in view of decreasing world oil reserves, ever heavier and hence paraffin-richer crude oils are being extracted and processed, which consequently also lead to paraffin-richer fuel oils. The paraffins present in middle distillates in particular can crystallize out as the temperature of the oil is lowered and agglomerate partly with intercalation of oil. This crystallization and agglomeration can result, in winter in particular, in blockages of the filters in engines and boilers, which prevents reliable metering of the fuels and, under some circumstances, can cause complete interruption of the fuel supply. The paraffin problem is additionally worsened by the hydrogenating desulfurization of fuel oils to be undertaken for environmental protection reasons for the purpose of lowering the sulfur content, which leads to an increased proportion of cold-critical paraffins in the fuel oil.

The cold flow properties of middle distillates are often improved by adding chemical additives known as cold flow improvers or flow improvers, which modify the crystal structure and agglomeration tendency of the paraffins which precipitate out such that the oils thus additized can still be pumped and used at temperatures which are often more than 20° C. lower than in the case of unadditized oils. The cold flow improvers used are typically oil-soluble copolymers of ethylene and unsaturated esters, oil-soluble polar nitrogen compounds and/or comb polymers. In addition, more specific additives have also been proposed.

WO 03/042 336 discloses additives for low-sulfur mineral oil distillates, comprising an ester of an alkoxylated polyol and a polar nitrogen-containing paraffin dispersant. The additives may be used together with detergent additives.

WO 03/042 337 discloses low-sulfur mineral oil distillates with improved cold properties, comprising an ester of an alkoxylated polyol and a copolymer of ethylene and unsaturated esters. The mineral oil distillates may further comprise detergent additives.

WO 03/042 338 discloses combinations of polyoxyalkylene compounds and alkylphenol resins as cold additives for middle distillates having a sulfur content of less than 0.05% by weight. The additives may be used together with detergent additives.

EP-A-0 973 848 discloses mixtures of esters of $C_{10}$-$C_{40}$-carboxylic acids and alkoxylated monohydric alcohols having more than 10 carbon atoms with at least one further cold flow improver. These mixtures are used to improve the cold flow properties of fuel oils. The additives may also comprise detergent additives which are not specified further.

U.S. Pat. No. 5,522,906 discloses gasoline which comprises a nitrogen-containing detergent additive, a carrier oil based on alkylene oxide adducts to alcohols, and esters of polyhydric alcohols or the alkylene oxide adducts thereof.

WO 03/078 553 discloses detergent additives for gasoline which comprise a nitrogen-containing detergent and optionally a polyether as a solvent.

WO 96/23855 discloses additive mixtures composed of ashless dispersant additives and carboxylic acids or esters thereof for improving the lubricity of low-sulfur middle distillates. This document does not give any indications of combined use with flow improvers.

In view of ever more demanding engine technology and rising demands on the environmental compatibility of fuel oils and their combustion products, detergent additives with ever higher effectiveness are being developed. In addition, they are often used in very high dosages. It is reported that, as a result, for example in the case of diesel fuels, the specific consumption is reduced and the performance of the engines is increased. However, these additives frequently have adverse effects on the cold flowability of middle distillates and in particular on the effectiveness of known cold flow improvers. Especially in the case of middle distillates with low final boiling point and simultaneously low aromatics content, it is frequently difficult or even impossible to attain satisfactory cold flow performance by means of conventional flow improvers in the presence of modern detergent additives. Thus, the paraffin dispersancy attained by paraffin dispersants is often impaired in the presence of detergent additives, without being able to be reestablished by increased dosage of paraffin dispersants. Often, the filterability, measured as the CFPP, of oils additized with cold flow improvers is significantly reduced under cold conditions and can be compensated only by greatly increased dosage of the flow improver.

Particularly problematic detergent additives in this context are especially those which derive from higher polyamines and have very high molecular weights caused, for example, by multiple alkylation and/or acylation of these polyamines. Often, problems in the cold additization are also caused by presence of nitrogen-containing detergent additives which either derive from higher polyamines or which bear a plurality of polyamine groups on their hydrophobic radical and hence bear a comparatively large polar end group.

It is thus an object of the present invention to improve the response behavior of cold flow improvers in middle distillates comprising detergent additives. It is a further object of the invention to provide a detergent additive which is an improvement over the prior art and does not impair the response behavior of cold flow improvers.

It has now been found that, surprisingly, certain oil-soluble polyoxyalkylene compounds counteract the impairment of the effectiveness of customary cold flow improvers by nitrogen-containing detergent additives or remove this impairment.

The invention thus provides for the use of at least one oil-soluble polyoxyalkylene compound, this polyoxyalkylene compound being an oil-soluble ester, ether or ether/ester of alkoxylated polyols having at least three repeat alkoxy units derived from alkylene oxides having from 2 to 5 carbon atoms per OH group of the polyol which bears at least two aliphatic hydrocarbon radicals having from 12 to 30 carbon atoms, for improving the response behavior of mineral oil cold flow improvers in middle distillates which comprise at least one ashless, nitrogen-containing detergent additive which is an oil-soluble amphiphilic compound which comprises at least one alkyl or alkenyl radical which is bonded to a polar group, the alkyl or alkenyl radical comprising from 10 to 500 carbon atoms and the polar group comprising 2 or more nitrogen atoms.

The invention further provides a process for improving the response behavior of mineral oil cold flow improvers in middle distillates which comprise ashless nitrogen-containing detergent additives, and in which the ashless nitrogen-containing detergent additives are oil-soluble amphiphilic compounds which comprise at least one alkyl or alkenyl radical which is bonded to a polar group, the alkyl or alkenyl radical having from 10 to 500 carbon atoms and the polar group having 2 or more nitrogen atoms, by adding to the oil at least one polyoxyalkylene compound which is an oil-soluble ester, ether or ether/ester of alkoxylated polyols having at least three repeat alkoxy units derived from alkylene oxides having from 2 to 5 carbon atoms per OH group of the polyol which bears at least two aliphatic hydrocarbon radicals having from 12 to 30 carbon atoms.

The invention further provides additives comprising a) at least one ashless nitrogen-containing detergent additive which is an oil-soluble amphiphilic compound which comprises at least one alkyl or alkenyl radical which is bonded to a polar group, the alkyl or alkenyl radical comprising from 10 to 500 carbon atoms and the polar group comprising 2 or more nitrogen atoms, and an oil-soluble ester, ether or ether/ester of alkoxylated polyols having at least three repeat alkoxy units derived from alkylene oxides having from 2 to 5 carbon atoms per OH group of the polyol which bears at least two aliphatic hydrocarbon radicals having from 12 to 30 carbon atoms.

The combination of a) and b) is also referred to hereinafter as "inventive additive".

The invention further provides middle distillates having a sulfur content of less than 100 ppm and a 90% distillation point of below 360° C., comprising a) at least one ashless nitrogen-containing detergent additive which is an oil-soluble amphiphilic compound which comprises at least one alkyl or alkenyl radical which is bonded to a polar group, the alkyl or alkenyl radical comprising from 10 to 500 carbon atoms and the polar group comprising 2 or more nitrogen atoms, b) an oil-soluble ester, ether or ether/ester of alkoxylated polyols having at least three repeat alkoxy units derived from alkylene oxides having from 2 to 5 carbon atoms per OH group of the polyol which bears at least two aliphatic hydrocarbon radicals having from 12 to 30 carbon atoms, and c) at least one mineral oil cold flow improver.

The response behavior of flow improvers is particularly impaired in middle distillates which contain more than 10 ppm of a nitrogen-containing detergent additive, in particular more than 20 ppm and especially more than 40 ppm, for example from 50 to 2000 ppm, of nitrogen-containing detergent additive.

The inventive additives preferably comprise, based on one part by weight of the nitrogen-containing detergent additive, from 0.01 to 10 parts by weight and in particular from 0.1 to 5 parts by weight, for example from 0.3 to 3 parts by weight, of the oil-soluble polyoxyalkylene compound.

Ashless means that the additives in question consist essentially only of elements which form gaseous reaction products in the combustion. The additives preferably consist essentially only of the elements carbon, hydrogen, oxygen and nitrogen. In particular, ashless additives are essentially free of metals and metal salts.

Preference is given to adding from 10 to 10000 ppm and in particular from 100 to 3000 ppm of the nitrogen-containing detergent additives to middle distillates.

The alkyl or alkenyl radical preferably imparts oil solubility to the detergent additives.

Particularly problematic detergent additives are those whose alkyl radical has from 15 to 500 carbon atoms and in particular from 20 to 350 carbon atoms, for example from 50 to 200 carbon atoms. This alkyl radical may be linear or branched; in particular, it is branched. In a preferred embodiment, the alkyl radical derives from oligomers of lower olefins having from 3 to 6 carbon atoms, such as propene, butene, pentene or hexene and mixtures thereof. Preferred isomers of these olefins are isobutene, 2-butene, 1-butene, 2-methyl-2-butene, 2,3-dimethyl-2-butene, 1-pentene, 2-pentene and isopentene, and mixtures thereof. Particular preference is given to propene, isobutene, 2-butene, 2,3-dimethyl-2-butene and mixtures thereof. Preferred mixtures of polyolefins contain more than 50 mol %, in particular more than 70%, for example more than 90 mol %, of isobutene. Particularly suitable for the preparation of such detergent additives are highly reactive low molecular weight polyolefins having a content of terminal double bonds of at least 75%, especially at least 85% and in particular at least 90%, for example at least 95%. Particularly preferred low molecular weight polyolefins are poly(isobutylene), poly(2-butene), poly(2-methyl-2-butene), poly(2,3-dimethyl-2-butene), poly(ethylene-co-isobutylene) and atactic poly(propylene). The molecular weight of particularly preferred polyolefins is between 500 and 3000 g/mol. Such oligomers of lower olefins are obtainable, for example, by polymerization by means of Lewis acids such as $BF_3$ and $AlCl_3$, by means of Ziegler catalysts and in particular by means of metallocene catalysts.

The polar fraction of the detergent additives which are particularly problematic for the response behavior of known cold additives derives from polyamines having from 2 to 20 nitrogen atoms. Such polyamines correspond, for example, to the formula $$(R^9)_2N\text{-}[A\text{-}N(R^9)]_q\text{—}(R^9)$$

in which each $R^9$ is independently hydrogen, an alkyl or hydroxyalkyl radical having up to 24 carbon atoms, a polyoxyalkylene radical $\text{-}(A\text{-}O)_r\text{—}$ or polyiminoalkylene radical $\text{-}[A\text{-}N(R^9)]_s\text{—}(R^9)$, though, at least one $R^9$ is hydrogen, q is an integer from 1 to 19, A is an alkylene radical having from 1 to 6 carbon atoms, r and s are each independently from 1 to 50. Typically, they are mixtures of polyamines and in particular mixtures of poly(ethyleneamines) and/or poly(propyleneamines). Examples include: ethylenediamine, 1,2-propylenediamine, dimethylaminopropylamine, diethylenetriamine (DETA), dipropylenetriamine, triethylenetetramine (TETA), tripropylenetetramine, tetraethylenepentamine (TEPA), tetrapropylenepentamine, pentaethylenehexamine (PEHA) pentapropylenehexamine and heavy polyamines. Heavy polyamines are generally understood to mean mixtures of polyalkylenepolyamines which, in addition to small amounts of TEPA and PEHA, comprise mainly oligomers having 7 or more nitrogen atoms, of which two or more are in the form of primary amino groups. These polyamines often also contain structural elements branched via tertiary amino groups.

Further suitable amines are those which include cyclic structural units which derive from piperazine. The piperazine units may preferably have, on one or both nitrogen atoms, hydrogen, an alkyl or hydroxyalkyl radical having up to 24 carbon atoms or a polyaminoalkylene radical $\text{-}[A\text{-}N(R^9)]_s\text{—}(R^9)$ where A, $R^9$ and s are each as defined above.

Further suitable amines include alicyclic diamines such as 1,4-di(aminomethyl)-cyclohexane and heterocyclic nitrogen compounds such as imidazolines and N-aminoalkylpiperazines, for example N-(2-aminoethyl)piperazine.

Detergent additives whose polar fraction derives from polyamines bearing hydroxyl groups, from polyamines substituted by heterocycles and from aromatic polyamines are also problematic. Examples include: N-(2-hydroxyethyl)ethylenediamine, N,$N^1$-bis(2-hydroxyethyl)ethylenediamine, N-(3-hydroxybutyl)-tetra(methylene)diamine, N-2-aminoethylpiperazine, N-2- and N-3-aminopropylmorpholine, N-3-(dimethylamino)propylpiperazine, 2-heptyl-3-(2-aminopropyl)imidazoline, 1,4-bis(2-aminoethyl)piperazine, 1-(2-hydroxyethyl)piperazine, various isomers of phenylenediamine and of naphthalenediamine, and mixtures of these amines.

Particularly critical detergent additives for the cold additization of middle distillates are those based on heavy polyamines in which, in the above formula, $R^9$ is hydrogen and q assumes values of at least 3, in particular at least 4, for example 5, 6, 7 or higher. Particularly problematic in this context are mixtures of polyamines which contain at least 40% by weight and in particular at least 60% by weight, for example at least 80% by weight, of higher polyamines having 5 and more nitrogen atoms. The heavy polyamines which are particularly efficient for the dispersion performance but particularly problematic for the cold additization are generally understood to mean mixtures of polyalkylenepolyamines which, in addition to TEPA and PEHA, contain relatively large amounts, i.e. at least 10% by weight and in particular at least 30% by weight, especially at least 50% by weight, for example more than 70% by weight, of oligomers having 7 or more nitrogen atoms.

The oil-soluble alkyl radical and the polar end group of the detergent additives may be bonded to one another either directly via a C—N— bond or via an ester, amide or imide bond. Preferred detergent additives are accordingly alkylpoly(amines), Mannich reaction products, hydrocarbon-substituted succinamides and -imides, and mixtures of these substance classes.

The detergent additives bonded via C—N bonds are preferably alkylpoly(amines) which are obtainable, for example, by reacting polyisobutylenes with polyamines, for example by hydroformylation and subsequent reductive amination with the abovementioned polyamines. One or more alkyl radicals may be bonded to the polyamine. Particularly critical detergent additives for cold additization are those based on higher polyamines having more than 4 nitrogen atoms, for example those having 5, 6, 7 or more nitrogen atoms.

Detergent additives containing amide or imide bonds are obtainable, for example, by reacting alkenylsuccinic anhydrides with polyamines. Alkenylsuccinic anhydride and polyamine are reacted preferably in a molar ratio of from about 1:0.5 to about 1:1. The parent alkenylsuccinic anhydrides are prepared typically by adding ethylenically unsaturated polyolefins or chlorinated polyolefins onto ethylenically unsaturated dicarboxylic acids.

For example, alkenylsuccinic anhydrides can be prepared by reacting chlorinated polyolefins with maleic anhydride. Alternatively, they can also be prepared by thermal addition of polyolefins to maleic anhydride in an "ene reaction". In this context, highly reactive olefins having a high content of, for example, more than 75% and especially more than 85 mol %, based on the total number of polyolefin molecules, of isomers with terminal double bond are particularly suitable. The terminal double bonds may be either vinylidene double bonds [$—CH_2—C(=CH_2)—CH_3$] or vinyl double bonds [$—CH=C(CH_3)_2$].

For the preparation of alkenylsuccinic anhydrides, the molar ratio of the two reactants in the reaction between maleic anhydride and polyolefin can vary within wide limits. It may preferably be between 10:1 and 1:5, particular preference being given to molar ratios of from 6:1 to 1:1. Maleic anhydride is used preferably in a stoichiometric excess, for example from 1.1:3 mol of maleic anhydride per mole of polyolefin. Excess maleic anhydride can be removed from the reaction mixture, for example by distillation.

Since the reactants formed as primary products by ene reaction in particular in turn contain an olefinic double bond, a further addition of unsaturated dicarboxylic acids with formation of so-called bismaleates is possible in a suitable reaction. The reaction products obtainable in this way have, based on the contents of the poly(olefins) reacted with unsaturated carboxylic acids, on average, a degree of maleation of more than 1, preferably from about 1.01 to 2.0 and in particular from 1.1 to 1.8 dicarboxylic acid units per alkyl radical. Reaction with the abovementioned amines forms products which have significantly enhanced effectiveness as detergent additives. On the other hand, the impairment of the effectiveness of cold flow improvers also increases with increasing degree of maleation. When such highly maleated alkenylsuccinic anhydrides are used, even relatively short-chain polyamines having, for example, 3, 4 or 5 nitrogen atoms lead to the stated problems in cold additization.

The reaction of alkenylsuccinic anhydrides with polyamines leads to products which may bear one or more amide and/or imide bonds per polyamine and, depending on the degree of maleation, one or two polyamines per alkyl radical. For the reaction, preference is given to using from 1.0 to 1.7 and in particular from 1.1 to 1.5 mol of alkenylsuccinic anhydride per mole of polyamine, so that free primary amino groups remain in the product. In a further preferred embodiment, alkenylsuccinic anhydride and polyamine are reacted in equimolar amounts. The reaction of polyamines with alkenylsuccinic anhydrides having a high degree of acylation of 1.1 or more anhydride groups per alkyl radical, for example 1.3 or more anhydride groups per alkyl radical, also forms polymers which are particularly problematic for the response behavior of cold additives.

Typical and particularly preferred acylated nitrogen compounds are obtainable by reacting poly(isobutylene)-, poly(2-butenyl)-, poly(2-methyl-2-butenyl)-, poly(2,3-dimethyl-2-butenyl)- and poly(propenyl)succinic anhydrides having an average of from about 1.2 to 1.5 anhydride groups per alkyl radical, whose alkyl radicals bear between 50 and 400 carbon atoms, with a mixture of poly(ethyleneamines) having at least 3 and preferably from 4 to 12, for example from 5 to 7, nitrogen atoms, and at least 2 and preferably from about 3 to 11, for example from 4 to 6, ethylene units.

Oil-soluble Mannich reaction products based on polyolefin-substituted phenols and polyamines also impair the effectiveness of conventional cold flow improvers. Such Mannich bases can be prepared by kn-own processes, for example by alkylation of phenol and/or salicylic acid with the above-described polyolefins, for example poly(isobutylene), poly(2-butene), poly(2-methyl-2-butene), poly(2,3-dimethyl-2-butene) or atactic poly(propylene) and subsequent condensation of the alkylphenols with aldehydes having from 1 to 6 carbon atoms, for example formaldehyde or its reactive equivalents such as formalin or paraformaldehyde, and the above-described polyamines, for example TEPA, PEHA or heavy polyamines.

The mean molecular weight, determined by means of vapor pressure osmometry, of detergent additives which are particularly efficient but simultaneously also particularly critical for the cold additization of middle distillates is above 800 g/mol and in particular between 2000 and 20000 g/mol, for example between 3000 and 15000 g/mol (measured by means of GPC against poly(styrene) standards in THF). The mean molecular weight of the above-described detergent additives can also be increased by means of crosslinking reagents and adjusted to the end use. Suitable crosslinking reagents are, for example, dialdehydes such as glutaraldehyde, bisepoxides, for example derived from bisphenol A, dicarboxylic acids and their reactive derivatives, for example maleic anhydride and alkenylsuccinic anhydrides, and higher polybasic carboxylic acids and derivatives thereof, for example trimellitic acid, trimellitic anhydride and pyromellitic dianhydride.

In a preferred embodiment, the oil-soluble polyoxyalkylene compounds have at least 3, for example 4, 5 or more, aliphatic hydrocarbon radicals. These radicals preferably each independently have from 16 to 26 carbon atoms, for example from 17 to 24 carbon atoms. The aliphatic hydrocarbon radicals may be linear or branched; they are preferably linear. Moreover, they are preferably very substantially saturated; in particular, they are alkyl radicals. Esters are particularly preferred.

Polyols particularly suitable in accordance with the invention are polyethylene glycols, polypropylene glycols, polybutylene glycols and their copolymers having a molecular weight of from approx. 100 to approx. 5000 g/mol, preferably from 200 to 2000 g/mol. In a particularly preferred embodiment, the oil-soluble polyoxyalkylene compounds derive from polyols having 3 or more OH groups, preferably from polyols having from 3 to about 500H groups, for example from 4 to 10 OH groups, especially from neopentyl glycol, glycerol, trimethylolethane, trimethylolpropane, sorbitan, pentaerythritol, and the oligomers which are obtainable therefrom by condensation and have from 2 to 10 monomer units, for example polyglycerol. Also suitable as polyols are higher polyols, for example sorbitol, sucrose, glucose, fructose and oligomers thereof, for example cyclodextrin, provided that their esterified or etherified alkoxylates are oil-soluble at least in amounts relevant to use. Preferred polyoxyalkylene compounds thus have a branched polyoxyalkylene core, to which a plurality of alkyl radicals which impart oil solubility are bonded. The polyols have generally been reacted with from 3 to 70 mol of alkylene oxide, preferably from 4 to 50 mol, in particular from 5 to 20 mol of alkylene oxide, per hydroxyl group of the polyol. Preferred alkylene oxides are ethylene oxide, propylene oxide and/or butylene oxide. The alkoxylation is effected by known processes.

The fatty acids suitable for the esterification of the alkoxylated polyols have preferably from 12 to 30 and in particular from 16 to 26 carbon atoms. The alkyl radicals of the fatty acids may be linear or branched; preferred fatty acids bear linear alkyl radicals. Suitable fatty acids are, for example, lauric acid, tridecanoic acid, myristic acid, pentadecanoic acid, palmitic acid, margaric acid, stearic acid, isostearic acid, arachic acid and behenic acid, oleic acid and erucic acid, palmitoleic acid, myristoleic acid, ricinoleic acid, and fatty acid mixtures obtained from natural fats and oils. Preferred fatty acid mixtures contain more than 50 mol % of fatty acids having at least 20 carbon atoms. Preferably less than 50 mol % of the fatty acids used for the esterification contain double bonds, especially less than 10 mol %; they are especially very substantially saturated. The esterification can also be effected starting from reactive derivatives of the fatty acids, such as esters with lower alcohols (for example methyl or ethyl esters) or anhydrides.

In the context of the present invention, very substantially saturated is understood to mean an iodine number of the fatty acid used or of the fatty alcohol used of up to 5 g of 1 per 100 g of fatty acid or fatty alcohol.

For the esterification of the alkoxylated polyols, it is also possible to use mixtures of the above fatty acids with fat-soluble, polybasic carboxylic acids. Examples of suitable polybasic carboxylic acids are dimer fatty acids, alkenylsuccinic acids and aromatic polycarboxylic acids, and their derivatives such as anhydrides and $C_1$- to $C_5$-esters. Preference is given to alkenylsuccinic acid and its derivatives with alkyl radicals having from 8 to 200, in particular from 10 to 50 carbon atoms. Examples are dodecenyl-, octadecenyl- and poly(isobutenyl)succinic anhydride. The polybasic carboxylic acids are preferably used in minor contents of up to 30 mol %, preferably from 1 to 20 mol %, in particular from 2 to 10 mol %.

Ester and fatty acid are used for the esterification, based on the content firstly of hydroxyl groups and secondly of carboxyl groups, in a ratio of from 1.5:1 to 1:1.5, preferably in a ratio of from 1.1:1 to 1:1.1 and in particular in an equimolar amount.

In a preferred embodiment, after the alkoxylation of the polyol, the terminal hydroxyl groups are converted to terminal carboxyl groups, for example by oxidation or by reaction with dicarboxylic acids. Reaction with fatty alcohols having from 8 to 50, in particular from 12 to 30, especially from 16 to 26 carbon atoms likewise affords inventive polyoxyalkylene esters. Preferred fatty alcohols or fatty alcohol mixtures contain more than 50 mol % of fatty alcohols having at least 20 carbon atoms. Preferably less than 50 mol % of the fatty alcohols used for the esterification contain double bonds, in particular less than 10 mol %; they are especially very substantially saturated. Also suitable in accordance with the invention are esters of alkoxylated fatty alcohols with fatty acids which contain abovementioned contents of poly(alkylene oxides) and whose fatty alcohol and fatty acid have abovementioned alkyl chain lengths and degrees of saturation.

The esterification is performed by customary processes. A particularly useful process has been found to be the reaction of polyol alkoxylate with fatty acids, optionally in the presence of catalysts, for example para-toluenesulfonic acid, $C_2$- to $C_{50}$-alkylbenzenesulfonic acids, methanesulfonic acid or acidic ion exchangers. The water of reaction can be removed by means of distillation by direct condensation or preferably by means of azeotropic distillation in the presence of organic solvents, especially aromatic solvents such as toluene, xylene or else higher-boiling mixtures such as ®Shellsol A, ®Shellsol B, ®Shellsol AB or Solvent Naphtha. The esterification is preferably effected essentially completely, i.e. from 1.0 to 1.5 mol of fatty acid are used per mole of hydroxyl groups for the esterification. The acid number of the esters is generally below 15 mg KOH/g, preferably below 10 mg KOH/g, especially below 5 mg KOH/g. The OH number of the esters is preferably below 20 mg KOH/g and especially below 10 mg KOH/g. Substantially complete esterification has been found to be advantageous for efficient action in conjunction with detergent additives. This also prevents the additized middle distillate from forming undesired emulsions with any water present in storage vessels.

In addition, the above-described alkoxylated polyols can be converted to polyoxyalkylene compounds suitable in accordance with the invention by etherification with fatty alcohols having from 8 to 50, in particular from 12 to 30, especially from 16 to 26 carbon atoms. The fatty alcohols preferred for this purpose are linear and very substantially saturated. Preference is given to etherifying completely or at least very substantially completely. The etherification is performed by known processes.

Particularly preferred polyoxyalkylene compounds derive from polyols having 3, 4 and 5 OH groups which, per hydroxyl group of the polyol, bear from about 5 to 10 mol of structural units derived from ethylene oxide and have been esterified very substantially fully with very substantially saturated $C_{17}$-$C_{24}$-fafty acids. Further particularly preferred polyoxyalkylene compounds are polyethylene glycols which have been esterified with very substantially saturated $C_{17}$-$C_{24}$-fatty acids and have molecular weights of from about 350 to 1000 g/mol. Examples of particularly suitable polyoxyalkylene compounds are polyethylene glycols which have been esterified with stearic acid and especially behenic acid and have molecular weights between 350 and 800 g/mol; neopentyl glycol 14-ethylene oxide distearate (neopentyl glycol alkoxylated with 14 mol of ethylene oxide and then esterified with 2 mol of stearic acid) and in particular neopentyl glycol 14-ethylene oxide dibehenate; glycerol 20-ethylene oxide tristearate, glycerol 20-ethylene oxide dibehenate and in particular glycerol 20-ethylene oxide tribehenate; trimethylolpropane 22-ethylene oxide tribehenate; sorbitan 25-ethylene oxide tristearate, sorbitan 25-ethylene oxide tetrastearate, sorbitan 25-ethylene oxide tribehenate and in particular sorbitan 25-ethylene oxide tetrabehenate; pentaerythritol 30-ethylene oxide tribehenate, pentaerythritol 30-ethylene oxide tetrastearate and in particular pentaerythritol 30-ethylene oxide tetrabehenate and pentaerythritol 20-ethylene oxide 10-propylene oxide tetrabehenate.

The quantitative ratio between detergent additive and polyoxyalkylene compound in the additized oil may vary within wide limits. It has been found to be particularly useful to use from 0.01 to 10 parts by weight, in particular from 0.1 to 5 parts by weight, for example from 0.3 to 3 parts by weight, of polyoxyalkylene compound per part by weight of detergent additive, based in each case on the active ingredient.

Useful flow improvers which may be used in the inventive middle distillates include in particular one or more of the following substance classes III to VII, preference being given to using ethylene copolymers (constituent III) or mixtures thereof with one or more of constituents IV to VII. Particularly useful mixtures have been found to be those of ethylene copolymers (constituent III) and alkylphenol-aldehyde resins (constituent V), of ethylene copolymers (constituent III) and comb polymers (constituent VI) and of ethylene copolymers (constituent III) and olefin (co)polymers (constituent VII). For paraffin dispersancy, particularly useful mixtures have been found to be those of ethylene copolymers (constituent III) with constituents IV and V or constituents IV and VI.

Preferred cold flow improvers as constituent III are copolymers of ethylene and olefinically unsaturated compounds. Suitable ethylene copolymers are in particular those which, in addition to ethylene, contain from 8 to 21 mol %, in particular from 10 to 18 mol %, of olefinically unsaturated compounds as comonomers.

The olefinically unsaturated compounds are preferably vinyl esters, acrylic esters, methacrylic esters, alkyl vinyl ethers and/or alkenes, and the compounds mentioned may be substituted by hydroxyl groups. One or more comonomers may be present in the polymer.

The vinyl esters are preferably those of the formula 1

$$CH_2{=}CH{-}OCOR^1 \quad (1)$$

where $R^1$ is $C_1$- to $C_{30}$-alkyl, preferably $C_4$- to $C_{16}$-alkyl, especially $C_6$- to $C_{12}$-alkyl. In a further embodiment, the alkyl groups mentioned may be substituted by one or more hydroxyl groups.

In a further preferred embodiment, $R^1$ is a branched alkyl radical or a neoalkyl radical having from 7 to 11 carbon atoms, in particular having 8, 9 or 10 carbon atoms. Particularly preferred vinyl esters derive from secondary and especially tertiary carboxylic acids whose branch is in the alpha-position to the carbonyl group. Suitable vinyl esters include vinyl acetate, vinyl propionate, vinyl butyrate, vinyl isobutyrate, vinyl hexanoate, vinyl heptanoate, vinyl octanoate, vinyl pivalate, vinyl 2-ethylhexanoate, vinyl laurate, vinyl stearate and Versatic esters such as vinyl neononanoate, vinyl neodecanoate, vinyl neoundecanoate.

In a further preferred embodiment, these ethylene copolymers contain vinyl acetate and at least one further vinyl ester of the formula 1 where $R^1$ is $C_4$- to $C_{30}$-alkyl, preferably $C_4$- to $C_{16}$-alkyl, especially $C_6$- to $C_{12}$-alkyl.

The acrylic esters are preferably those of the formula 2

$$CH_2{=}CR^2{-}COOR^3 \quad (2)$$

where $R^2$ is hydrogen or methyl and $R^3$ is $C_1$- to $C_{30}$-alkyl, preferably $C_4$- to $C_{16}$-alkyl, especially $C_6$- to $C_{12}$-alkyl. Suitable acrylic esters include, for example, methyl(meth)acrylate, ethyl(meth)acrylate, propyl(meth)acrylate, n- and isobutyl(meth)acrylate, hexyl, octyl, 2-ethylhexyl, decyl, dodecyl, tetradecyl, hexadecyl, octadecyl (meth)acrylate and mixtures of these comonomers. In a further embodiment, the alkyl groups mentioned may be substituted by one or more hydroxyl groups. An example of such an acrylic ester is hydroxyethyl methacrylate.

The alkyl vinyl ethers are preferably compounds of the formula 3

$$CH_2{=}CH{-}OR^4 \quad (3)$$

where $R^4$ is $C_1$- to $C_{30}$-alkyl, preferably $C_4$- to $C_{16}$-alkyl, especially $C_6$- to $C_{12}$-alkyl. Examples include methyl vinyl ether, ethyl vinyl ether, isobutyl vinyl ether. In a further embodiment, the alkyl groups mentioned may be substituted by one or more hydroxyl groups.

The alkenes are preferably monounsaturated hydrocarbons having from 3 to 30 carbon atoms, in particular from 4 to 16 carbon atoms and especially from 5 to 12 carbon atoms. Suitable alkenes include propene, butene, isobutylene, pentene, hexene, 4-methylpentene, octene, diisobutylene and norbornene and derivatives thereof such as methylnorbornene and vinyinorbornene. In a further embodiment, the alkyl groups mentioned may be substituted by one or more hydroxyl groups.

Apart from ethylene, particularly preferred terpolymers contain from 3.5 to 20 mol %, in particular from 8 to 15 mol %, of vinyl acetate, and from 0.1 to 12 mol %, in particular from 0.2 to 5 mol %, of at least one relatively long-chain and preferably branched vinyl ester, for example vinyl 2-ethylhexanoate, vinyl neononanoate or vinyl neodecanoate, the total comonomer content being between 8 and 21 mol %, preferably between 12 and 18 mol %. Further particularly preferred copolymers contain, in addition to ethylene and from 8 to 18 mol % of vinyl esters of $C_2$- to $C_{12}$-caraboxylic acids, also from 0.5 to 10 mol % of olefins such as propene, butene, isobutylene, hexene, 4-methylpentene, octene, diisobutylene and/or norbornene.

These ethylene co- and terpolymers preferably have melt viscosities at 140° C. of from 20 to 10000 mPas, in particular from 30 to 5000 mPas, especially from 50 to 2000 mPas. The degrees of branching determined by means of $^1H$ NMR spectroscopy are preferably between 1 and 9 $CH_3$/100 $CH_2$ groups, in particular between 2 and 6 $CH_3$/100 $CH_2$ groups, which do not stem from the comonomers.

Preference is given to using mixtures of two or more of the above-mentioned ethylene copolymers. More preferably, the polymers on which the mixtures are based differ in at least one characteristic. For example, they may contain different comonomers, or have different comonomer contents, molecular weights and/or degrees of branching.

The mixing ratio between the inventive additives and ethylene copolymers as constituent III may, depending on the application, vary within wide limits, the ethylene copolymers III often constituting the major proportion. Such additive and oil mixtures preferably contain from 0.1 to 25, preferably from 0.5 to 10, parts by weight of ethylene copolymers per part by weight of the inventive additive combination.

Further suitable cold flow improvers are oil-soluble polar nitrogen compounds (constituent IV). These are preferably reaction products of fatty amines with compounds which contain an acyl group. The preferred amines are compounds of the formula $NR^6R^7R^8$ where $R^6$, $R^7$ and $R^8$ may be the same or different, and at least one of these groups is $C_8$-$C_{36}$-alkyl, $C_6$-$C_{36}$-cycloalkyl or $C_8$-$C_{36}$-alkenyl, in particular $C_{12}$-$C_{24}$-alkyl, $C_{12}$-$C_{24}$-alkenyl or cyclohexyl, and the remaining groups are either hydrogen, $C_1$-$C_{36}$-alkyl, $C_2$-$C_{36}$-alkenyl, cyclohexyl, or a group of the formulae $-(A\text{-}O)_x\text{-}E$ or $—(CH_2)_n—NYZ$, where A is an ethyl or propyl group, x is a number from 1 to 50, E=H, $C_1$-$C_{30}$-alkyl, $C_5$-$C_{12}$-cycloalkyl or $C_6$-$C_{30}$-aryl, and n=2, 3 or 4, and Y and Z are each independently H, $C_1$-$C_{30}$-alkyl or $-(A\text{-}O)_x$. The alkyl and alkenyl radicals may each be linear or branched and contain up to two double bonds. They are preferably linear and substantially saturated, i.e. they have iodine numbers of less than 75 g of $I_2$/g, preferably less than 60 g of $I_2$/g and in particular between 1 and 10 g of $I_2$/g. Particular preference is given to secondary fatty amines in which two of the $R^6$, $R^7$ and $R^8$ groups are each $C_8$-$C_{36}$-alkyl, $C_6$-$C_{36}$-cycloalkyl, $C_8$-$C_{36}$-alkenyl, in particular $C_{12}$-$C_{24}$-alkyl, $C_{12}$-$C_{24}$-alkenyl or cyclohexyl. Suitable fatty amines are, for example, octylamine, decylamine, dodecylamine, tetradecylamine, hexadecylamine, octadecylamine, eicosylamine, behenylamine, didecylamine, didodecylamine, ditetradecylamine, dihexadecylamine, dioctadecylamine, dieicosylamine, dibehenylamine and mixtures thereof. The amines especially contain chain cuts based on natural raw materials, for example coconut fatty amine, tallow fatty amine, hydrogenated tallow fatty amine, dicoconut fatty amine, ditallow fatty amine and di(hydrogenated tallow fatty amine). Particularly preferred amine derivatives are amine salts, imides and/or amides, for example amide-ammonium salts of secondary fatty amines, in particular of dicoconut fatty amine, ditallow fatty amine and distearylamine.

Acyl group refers here to a functional group of the following formula:

$$>C{=}O$$

Carbonyl compounds suitable for the reaction with amines are either monomeric or polymeric compounds having one or more carboxyl groups. Preference is given to those monomeric carbonyl compounds having 2, 3 or 4 carbonyl groups. They may also contain heteroatoms such as oxygen, sulfur and nitrogen. Suitable carboxylic acids are, for example, maleic acid, fumaric acid, crotonic acid, itaconic acid, succinic acid, $C_1$-$C_{40}$-alkenylsuccinic acid, adipic acid, glutaric acid, sebacic acid and malonic acid, and also benzoic acid, phthalic acid, trimellitic acid and pyromellitic acid, nitrilotriacetic acid, ethylenediaminetetraacetic acid and their reactive derivatives, for example esters, anhydrides and acid halides. Useful polymeric carbonyl compounds have been found to be in particular copolymers of ethylenically unsaturated acids, for example acrylic acid, methacrylic acid, maleic acid, fumaric acid and itaconic acid; particular preference is given to copolymers of maleic anhydride. Suitable comonomers are those which impart oil solubility to the copolymer. Oil-soluble means here that the copolymer, after reaction with the fatty amine, dissolves without residue in the middle distillate to be additized in practically relevant dosages. Suitable comonomers are, for example, olefins, alkyl esters of acrylic acid and methacrylic acid, alkyl vinyl esters, alkyl vinyl ethers having from 2 to 75, preferably from 4 to 40 and in particular from 8 to 20, carbon atoms in the alkyl radical. In the case of olefins, the carbon number is based on the alkyl radical attached to the double bond. The molecular weights of the polymeric carbonyl compounds are preferably between 400 and 20000, more preferably between 500 and 10000, for example between 1000 and, 5000.

It has been found that particularly useful oil-soluble polar nitrogen compounds are those which are obtained by reaction of aliphatic or aromatic amines, preferably long-chain aliphatic amines, with aliphatic or aromatic mono-, di-, tri- or tetracarboxylic acids or their anhydrides (cf. U.S. Pat. No. 4,211,534). Equally suitable as oil-soluble polar nitrogen compounds are amides and ammonium salts of aminoalkylenepoly-carboxylic acids such as nitrilotriacetic acid or ethylenediaminetetraacetic acid with secondary amines (cf. EP 0 398 101). Other oil-soluble polar nitrogen compounds are copolymers of maleic anhydride and α,β-unsaturated compounds which may optionally be reacted with primary monoalkylamines and/or aliphatic alcohols (cf. EP-A-0 154 177, EP 0 777 712), the reaction products of alkenyl-spirobislactones with amines (cf. EP-A-0 413 279 B1) and, according to EP-A-0 606 055 A2, reaction products of terpolymers based on α,β-unsaturated dicarboxylic anhydrides, α, β-unsaturated compounds and polyoxyalkylene ethers of lower unsaturated alcohols.

The mixing ratio between the inventive ethylene copolymers III and oil-soluble polar nitrogen compounds as constituent IV may vary depending upon the application. Such additive mixtures preferably contain, based on the active ingredients, from 0.1 to 10 parts by weight, preferably from 0.2 to 5 parts by weight, of at least one oil-soluble polar nitrogen compound per part by weight of the inventive additive combination.

Also suitable as flow improvers are alkylphenol-aldehyde resins as constituent V. These are in particular those alkylphenol-aldehyde resins which derive from alkylphenols having one or two alkyl radicals in the ortho- and/or para-position to the OH group. Particularly preferred starting materials are alkylphenols which bear, on the aromatic, at least two hydrogen atoms capable of condensation with aldehydes, and in particular monoalkylated phenols. The alkyl radical is more preferably in the para-position to the phenolic OH group. The alkyl radicals (for constituent V, this refers generally to hydrocarbon radicals as defined above) may be the same or different in the alkylphenol-aldehyde resins usable in the process according to the invention, they may be saturated or unsaturated and have 1-200, preferably 1-20, in particular 4-16, for example 6-12 carbon atoms; they are preferably n-, iso- and tert-butyl, n- and isopentyl, n- and isohexyl, n- and isooctyl, n- and isononyl, n- and isodecyl, n- and isododecyl, tetradecyl, hexadecyl, octadecyl, tripropenyl, tetrapropenyl, poly (propenyl) and poly(isobutenyl) radicals. In a preferred embodiment, the alkylphenol resins are prepared by using mixtures of alkylphenols with different alkyl radicals. For example, resins based firstly on butylphenol and secondly on octyl-, nonyl- and/or dodecylphenol in a molar ratio of from 1:10 to 10:1 have been found to be particularly useful.

Suitable alkylphenol resins may also contain or consist of structural units of further phenol analogs such as salicylic acid, hydroxybenzoic acid and derivatives thereof, such as esters, amides and salts.

Suitable aldehydes for the alkylphenol-aldehyde resins are those having from 1 to 12 carbon atoms and preferably having from 1 to 4 carbon atoms, for example formaldehyde, acetaldehyde, propionaldehyde, butyraldehyde, 2-ethylhexanal, benzaldehyde, glyoxalic acid and their reactive equivalents such as paraformaldehyde and trioxane. Particular preference is given to formaldehyde in the form of paraformaldehyde and especially formalin.

The molecular weight of the alkylphenol-aldehyde resins, measured by means of gel permeation chromatography against poly(styrene) standards in THF, is preferably 500-25000 g/mol, more preferably 800-10000 g/mol and especially 1000-5000 g/mol, for example 1500-3000 g/mol. A prerequisite here is that the alkylphenol-aldehyde resins are oil-soluble at least in concentrations relevant to use of from 0.001 to 1% by weight.

In a preferred embodiment of the invention, they are alkylphenol-formaldehyde resins which contain oligo- or polymers with a repeat structural unit of the formula

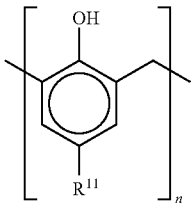

where $R^{11}$ is $C_1$-$C_{200}$-alkyl or -alkenyl, O—$R^{10}$ or O—C(O)—$R^{10}$, $R^{10}$ is $C_1$-$C_{200}$-alkyl or -alkenyl and n is from 2 to 100. $R^{10}$ is preferably $C_1$-$C_{20}$-alkyl or -alkenyl and in particular $C_4$-$C_{16}$-alkyl or -alkenyl, for example $C_6$-$C_{12}$-alkyl or -alkenyl. $R^{11}$ is more preferably $C_1$-$C_{20}$-alkyl or -alkenyl and in particular $C_4$-$C_{16}$-alkyl or -alkenyl, for example $C_6$-$C_{12}$-alkyl or -alkenyl. n is preferably from 2 to 50 and especially from 3 to 25, for example from 5 to 15.

These alkylphenol-aldehyde resins are obtainable by known processes, for example by condensing the corresponding alkylphenols with formaldehyde, i.e. with from 0.5 to 1.5 mol, preferably from 0.8 to 1.2 mol of formaldehyde per mole of alkylphenol. The condensation can be effected without solvent, but is preferably effected in the presence of a water-immiscible or only partly water-miscible inert organic solvent such as mineral oils, alcohols, ethers and the like. Particular preference is given to solvents which can form azeotropes with water. The solvents of this type used are in particular aromatics such as toluene, xylene, diethylbenzene and relatively high-boiling commercial solvent mixtures such as ®Shellsol AB, and Solvent Naphtha. Also suitable as solvents are fatty acids and derivatives thereof, for example esters with lower alcohols having from 1 to 5 carbon atoms, for example ethanol and especially methanol. The condensation is effected preferably between 70 and 200° C., for example between 90 and 160° C. It is typically catalyzed by from 0.05 to 5% by weight of bases or preferably by from 0.05 to 5% by weight of acids. As acidic catalysts, in addition to carboxylic acids such as acetic acid and oxalic acid, in particular strong mineral acids such as hydrochloric acid, phosphoric acid and sulfuric acid, and also sulfonic acids, are useful catalysts. Particularly suitable catalysts are sulfonic acids which contain at least one sulfonic acid group and at least one saturated or unsaturated, linear, branched and/or cyclic hydrocarbon radical having from 1 to 40 carbon atoms and preferably having from 3 to 24 carbon atoms. Particular preference is given to aromatic sulfonic acids, especially the alkylaromatic monosulfonic acids having one or more $C_1$-$C_{28}$-alkyl radicals and especially those having $C_3$-$C_{22}$-alkyl radicals. Suitable examples are methanesulfonic acid, butanesulfonic acid, benzenesulfonic acid, p-toluenesulfonic acid, xylenesulfonic acid, 2-mesitylenesulfonic acid, 4-ethylbenzenesulfonic acid, isopropylbenzenesulfonic acid, 4-butylbenzenesulfonic acid, 4-octylbenzenesulfonic acid; dodecyl-benzenesulfonic acid, didodecylbenzenesulfonic acid, naphthalene-sulfonic acid. Mixtures of these sulfonic acids are also suitable. Typically, after the reaction has ended, they remain in the product as such or in neutralized form. For neutralization, preference is given to using amines and/or aromatic bases, since they can remain in the product; salts which comprise metal ions and hence form ash are usually removed.

Comb polymers likewise suitable as flow improvers (constituent VI) can be described, for example, by the formula

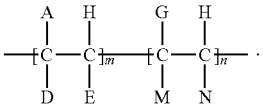

In this formula,

A is R', COOR', OCOR', R"—COOR', OR';

D is H, $CH_3$, A or R";

E is H, A;

G is H, R", R"—COOR', an aryl radical or a heterocyclic radical;

M is H, COOR", OCOR", OR", COOH;

N is H, R", COOR", OCOR, an aryl radical;

R' is a hydrocarbon chain having from 8 to 50 carbon atoms;

R" is a hydrocarbon chain having from 1 to 10 carbon atoms;

m is from 0.4 to 1.0; and n is from 0 to 0.6.

Suitable comb polymers are, for example, copolymers of ethylenically unsaturated dicarboxylic acids, such as maleic acid or fumaric acid, with other ethylenically unsaturated monomers, such as olefins or vinyl esters, for example vinyl acetate. Particularly suitable olefins in this context are α-olefins having from 10 to 24 carbon atoms, for example 1-decene, 1-dodecene, 1-tetradecene, 1-hexadecene, 1-octadecene and mixtures thereof. Longer-chain olefins based on oligomerized $C_2$-$C_6$-olefins, for example poly(isobutylene) having a high content of terminal double bonds, are also suitable as comonomers. Typically, these copolymers are esterified to an extent of at least 50% with alcohols having from 10 to 22 carbon atoms. Suitable alcohols include n-decan-1-ol, n-dodecan-1-ol, n-tetradecan-1-ol, n-hexadecan-1-ol, n-octadecan-1-ol, n-eicosan-1-ol and mixtures thereof. Particular preference is given to mixtures of n-tetradecan-1-ol and n-hexadecan-1-ol. Likewise suitable as comb polymers are poly(alkyl acrylates), poly(alkyl methacrylates) and poly(alkyl vinyl ethers) which derive from alcohols having from 12 to 20 carbon atoms, and poly(vinyl esters) which derive from fatty acids having from 12 to 20 carbon atoms.

Also suitable as flow improvers are homo- and copolymers of olefins having from 2 to 30 carbon atoms (constituent VII).

These may derive directly from monoethylenically unsaturated monomers or indirectly by hydrogenation of polymers which derive from polyunsaturated monomers such as isoprene or butadiene. Preferred copolymers contain, in addition of ethylene, structural units which derive from α-olefins having from 3 to 24 carbon atoms and have molecular weights of up to 120000 g/mol. Preferred α-olefins are propylene, butene, isobutene, n-hexene, isohexene, n-octene, isooctene, n-decene, isodecene. The comonomer content of olefins is preferably between 15 and 50 mol %, more preferably between 20 and 35 mol % and especially between 30 and 45 mol %. These copolymers may also contain small amounts, for example up to 10 mol %, of further comonomers, for example nonterminal olefins or nonconjugated olefins. Particular preference is given to ethylene-propylene copolymers. Preference is further given to copolymers of different olefins having from 5 to 30 carbon atoms, for example poly(hexene-co-decene). The olefin homo- and copolymers can be prepared by known methods, for example by means of Ziegler or metallocene catalysts.

Further suitable olefin copolymers are block copolymers which contain blocks formed from olefinically unsaturated, aromatic monomers A and blocks formed from hydrogenated polyolefins B. Particularly suitable block copolymers are those of the structure (AB)nA and (AB)m, where n is from 1 to 10 and m is from 2 to 10.

The mixing ratio between the inventive additives and the further constituents V, VI and VII is generally in each case between 1:10 and 10:1, preferably between 1:5 and 5:1.

For the purpose of simpler handling, the inventive additives are preferably used in the form of concentrates which contain from 10 to 95% by weight and preferably from 20 to 80% by weight, for example from 25 to 60% by weight, of solvent. Preferred solvents are relatively high-boiling, low-viscosity aliphatic, aromatic and alkylaromatic hydrocarbons, alcohols, esters, ethers and mixtures thereof. Such concentrates preferably contain from 0.01 to 10 parts by weight, preferably from 0.1 to 5 parts by weight, for example from 0.3 to 3 parts by weight, of the polyoxyalkylene compound per part by weight of detergent additive.

The inventive polyoxyalkylene compounds improve the response behavior of middle distillates comprising detergent additive, such as kerosene, jet fuel, diesel and heating oil for conventional flow improvers with regard to the lowering of pour point and CFPP value and the improvement of the paraffin dispersancy.

Particularly preferred mineral oil distillates are middle distillates. Middle distillates refer in particular to those mineral oils which are obtained by distilling crude oil and boil within the range from about 150 to 450° C. and in particular within the range from about 170 to 390° C., for example kerosene, jet fuel, diesel oil and heating oil. Typically, middle distillates contain from about 5 to 50% by weight, for example from about 10 to 35% by weight, of n-paraffins, among which the relatively long-chain n-paraffins crystallize out in the course of cooling and can impair the flowability of the middle distillate. The inventive compositions are particularly advantageous in middle distillates with low aromatics content of less than 21% by weight, for example less than 19% by weight. The inventive compositions are also particularly advantageous in middle distillates with low final boiling point, i.e. in those middle distillates which have 90% distillation points below 360° C., in particular 350° C. and in special cases below 340° C., and additionally in those middle distillates which have boiling ranges between 20 and 90% distillation volumes of less than 120° C. and in particular of less than 110° C. Aromatic compounds are understood to mean the sum of mono-, di- and polycyclic aromatic compounds, as can be determined by means of HPLC to DIN EN 12916 (2001 edition). The middle distillates may also contain minor amounts, for example up to 40% by volume, preferably from 1 to 20% by volume, especially from 2 to 15% by volume, for example from 3 to 10% by volume, of the oils of animal and/or vegetable origin described in detail below, for example fatty acid methyl esters.

The inventive compositions are likewise suitable for improving the cold properties of fuels which comprise detergent additives and are based on renewable raw materials (biofuels). Biofuels are understood to mean oils which are obtained from animal material and preferably from vegetable material or both, and derivatives thereof, which can be used as a fuel and in particular as a diesel or heating oil. They are in particular triglycerides of fatty acids having from 10 to 24 carbon atoms, and also the fatty acid esters of lower alcohols, such as methanol or ethanol, obtainable from them by transesterification.

Examples of suitable biofuels are rapeseed oil, coriander oil, soybean oil, cottonseed oil, sunflower oil, castor oil, olive oil, groundnut oil, corn oil, almond oil, palm kernel oil, coconut oil, mustard seed oil, bovine tallow, bone oils, fish oils and used cooking oils. Further examples include oils which derive from wheat, jute, sesame, shea tree nut, arachis oil and linseed oil. The fatty acid alkyl esters also known as biodiesel can be derived from these oils by processes known in the prior art. Rapeseed oil, which is a mixture of fatty acids esterified with glycerol, is preferred, since it is obtainable in large amounts and is obtainable in a simple manner by extractive pressing of rapeseed. Preference is further given to the likewise widespread oils of sunflowers, palms and soya, and mixtures thereof with rapeseed oil.

Particularly suitable biofuels are lower alkyl esters of fatty acids. Useful examples here are commercial mixtures of the ethyl esters, propyl esters, butyl esters and especially methyl esters of fatty acids having from 14 to 22 carbon atoms, for example of lauric acid, myristic acid, palmitic acid, palmitoleic acid, stearic acid, oleic acid, elaidic acid, petroselic acid, ricinoleic acid, eleostearic acid, linoleic acid, linolenic acid, eicosanoic acid, gadoleic acid, docosanoic acid or erucic acid. Preferred esters have an iodine number of from 50 to 150 and especially of from 90 to 125. Mixtures with particularly advantageous properties are those which contain mainly, i.e. to an extent of at least 50% by weight, methyl esters of fatty acids having from 16 to 22 carbon atoms and 1, 2 or 3 double bonds. The preferred lower alkyl esters of fatty acids are the methyl esters of oleic acid, linoleic acid, linolenic acid and erucic acid.

The additives may be used alone or else together with other additives, for example with other pour point depressants or dewaxing assistants, with other detergents, with antioxidants, cetane number improvers, dehazers, demulsifiers, dispersants, antifoams, dyes, corrosion inhibitors, lubricity additives, sludge inhibitors, odorants and/or additives for lowering the cloud point.

EXAMPLES

Improvement in the cold flowability of middle distillates

To assess the effect of the inventive additives on the cold flow properties of middle distillates, detergent additives (A) were used with various polyoxyalkylene compounds (B), and also ethylene copolymers (C) and paraffin dispersants (D) with the characteristics specified below.

The suppression of the adverse effect of the detergent additives on known cold flow improvers for mineral oils and mineral oil distillates by polyoxyalkylene compounds is described firstly with the aid of the CFPP test (Cold Filter Plugging Test to EN 116).

In addition, the paraffin dispersancy in middle distillates is determined as follows in the brief sedimentation test:

150 ml of the middle distillates admixed with the additive components specified in the table were cooled to −13° C. at −2° C./hour in a cold cabinet, and stored at this temperature for 16 hours. Subsequently, volume and appearance both of the sedimented paraffin phase and of the supernatant oil phase are determined and assessed visually. A small amount of sediment and an opaque oil phase show good paraffin dispersancy.

In addition, directly after the cold storage, the lower 20% by volume are isolated and the cloud point is determined to IP 3015. An only low deviation of the cloud point of the lower phase ($CP_{cc}$) from the blank value of the oil shows good paraffin dispersancy.

Table 1: Characterization of the Test Oils:

The test oils employed were current middle distillates from European refineries. The CFPP value was determined to EN 116 and the cloud point to ISO 3015. The aromatic hydrocarbon groups were determined to DIN EN 12916 (November 2001 edition).

| | | Test oil 1 | Test oil 2 | Test oil 3 | Test oil 4 |
|---|---|---|---|---|---|
| Distillation | | | | | |
| IBP | [° C.] | 192 | 186 | 165 | 184 |
| 20% | [° C.] | 250 | 222 | 228 | 225 |
| 90% | [° C.] | 322 | 324 | 335 | 338 |
| (90-20)% | [° C.] | 72 | 102 | 107 | 113 |
| FBP | [° C.] | 347 | 352 | 359 | 363 |
| Cloud Point | [° C.] | −8.0 | −8.9 | −4.4 | −6.7 |
| CFPP | [° C.] | −10 | −10 | −5 | −9 |
| Density @15° C. | [g/cm$^3$] | 0.835 | 0.8307 | 0.8273 | 0.8340 |
| Sulfur content | [ppm] | <10 | <10 | 15 | 31 |
| Aromatics content of which | [% by wt.] | 19.6 | 18.8 | 22.8 | 22.7 |
| mono | [% by wt.] | 18.0 | 18.2 | 20.6 | 20.7 |
| di | [% by wt.] | 1.6 | 0.6 | 2.1 | 2.0 |
| poly | [% by wt.] | <0.1 | <0.1 | 0.1 | <0.1 |

The following additives were used:

(A) Characterization of the Detergent Additives Used

The detergent additives A used were various reaction products, listed in Table 2, of alkenylsuccinic anhydrides (degree of maleation from about 1.2 to 1.3) based on high-reactivity polyolefins (see Table 2 for molecular weight; content of terminal double bonds >90%) with polyamines. To this end, alkenylsuccinic anhydride and polyamine were reacted in a molar ratio of from 1.0 to 1.5 mol of acid anhydride groups (AA) per mole of polyamine (see Table 2). For better dosability, the detergent additives were used in the form of 33% solutions in relatively high-boiling aromatic solvent; the dosages specified in Tables 2 to 4 for the detergent additives are, however, based on the active ingredient used.

(B) Characterization of the Polyoxyalkylene Compounds Used

B1) glycerol 20-ethylene oxide tribehenate, 50% in Solvent Naphtha.

B2) glycerol 28-ethylene oxide tristearate, 50% in Solvent Naphtha

B3) pentaerythritol 30-ethylene oxide tetrabehenate, 50% in Solvent Naphtha

B4) polyethylene glycol 600-dibehenate, 50% in Solvent Naphtha

In Examples B1) to B3), the numbers 20, 28 and 30 specify the number of moles of alkylene oxide per mole of glycerol. In Example B4), the number 600 specifies the molecular weight of the polyethylene glycol used for the esterification.

Characterization of the further flow improvers

C1) Terpolymer of ethylene, 30% by weight of vinyl acetate and 8% by weight of vinyl neodecanoate having a melt viscosity $V_{140}$ measured at 140° C. of 95 mPas, 65% in kerosene C2) Mixture of equal parts of C1) and a copolymer of ethylene and 32% by weight of vinyl acetate having a melt viscosity $V_{140}$ measured at 140° C. of 125 mPas, 56% in kerosene.

D1) Mixture of 2 parts of reaction product of a copolymer of $C_{14}/C_{16}$-α-olefin and maleic anhydride with 2 equivalents of hydrogenated ditallow fat amine with one part of nonylphenol-formaldehyde resin, 50% in Solvent Naphtha.

D2) Reaction product of ethylenediaminetetraacetic acid with 4 equivalents of ditallow fatty amine to give the amide-ammonium salt, prepared according to EP 0 398 101, 50% in Solvent Naphtha.

D3) Mixture of equal parts of a reaction product of phthalic anhydride and 2 equivalents of di(hydrogenated tallow fat) amine with a copolymer of ditetradecyl fumarate, 50% in Solvent Naphtha.

The CFPP values in test oil 1 were determined after the oil had been additized with 200 ppm of C2 and 150 ppm of D1.

TABLE 2

Cold flow improvement in test oil 1

| | Detergent additive (DA) | | | | | CFPP in test oil 1/° C. | | |
|---|---|---|---|---|---|---|---|---|
| Example | Polyolefin | Polyolefin Mw | Polyamine | mol of AS/mol of polyamine | DA dosage/ppm | without DA | with DA | with DA +50 ppm B1 |
| 1 | PIB | 700 | TEPA | 1.0 | 150 | −29 | −25 | −28 |
| 2 | PIB | 700 | TEPA | 1.4 | 150 | −29 | −26 | −28 |
| 3 | PIB | 1000 | PEHA | 1.0 | 150 | −29 | −22 | −29 |
| 4 | PIB | 1000 | PEHA | 1.5 | 150 | −29 | −21 | −28 |
| 5 | PIB | 1000 | PAM | 1.0 | 150 | −29 | −18 | −30 |
| 6 | PIB | 1000 | PAM | 1.3 | 150 | −29 | −15 | −28 |
| 7 | APP | 1150 | TEPA | 1.0 | 150 | −29 | −25 | −28 |
| 8 | APP | 1150 | TEPA | 1.5 | 150 | −29 | −25 | −30 |
| 9 | APP | 1150 | PEHA | 1.1 | 150 | −29 | −24 | −30 |
| 10 | APP | 1150 | PEHA | 1.5 | 150 | −29 | −26 | −28 |
| 11 | APP | 1150 | PAM | 1.0 | 150 | −29 | −20 | −28 |
| 12 | APP | 1150 | PAM | 1.5 | 150 | −29 | −20 | −28 |
| 13 | P2B | 1000 | TEPA | 1.0 | 150 | −29 | −21 | −29 |
| 14 | P2B | 1000 | TEPA | 1.3 | 150 | −29 | −20 | −27 |

TABLE 2-continued

| Cold flow improvement in test oil 1 | | | | | | | | |
|---|---|---|---|---|---|---|---|---|
| | Detergent additive (DA) | | | | | CFPP in test oil 1/° C. | | |
| Example | Polyolefin | Polyolefin Mw | Polyamine | mol of AS/mol of polyamine | DA dosage/ppm | without DA | with DA | with DA +50 ppm B1 |
| 15 | P2B | 1200 | PEHA | 1.0 | 150 | −29 | −20 | −28 |
| 16 | P2B | 1200 | PEHA | 1.4 | 150 | −29 | −18 | −28 |
| 17 | P2B | 1000 | PAM | 1.1 | 150 | −29 | −11 | −29 |
| 18 | P2B | 1000 | PAM | 1.4 | 150 | −29 | −14 | −30 |

DA = Detergent additive;
PIB = Poly(isobutylene);
APP = Atactic poly(propylene);
P2B = Poly(butene) formed from mixture of different butene isomers having a content of 2-butene of approx. 80%;
TEPA = Tetraethylenepentamine;
PEHA = Pentaethylenehexamine;
PAM = Heavy polyamine In the examples of Tables 3 to 5 below, the detergent additive A1 used was the reaction product of poly(isobutenyl) succinic anhydride and pentaethylenehexamine according to Table 2, Example 3, the detergent additive A2 used was the reaction product of poly(isobutenyl)succinic anhydride and pentaethylenehexamine according to Table 2, Example 4, and the detergent additive A3 used was the reaction product of poly(butenyl)succinic anhydride and heavy polyamines according to Table 2, Example 18.

TABLE 3

| Cold flow improvement in test oil 2 | | | | | |
|---|---|---|---|---|---|
| | Additives | | | | Test oil 2 CFPP |
| Example | A | B | C | D | [° C.] |
| 19 (Comp.) | — | — | 75 ppm C2 | — | −14 |
| 20 (Comp.) | — | — | 100 ppm C2 | — | −19 |
| 21 (Comp.) | — | — | 150 ppm C1 | — | −20 |
| 22 (Comp.) | — | — | 75 ppm C1 | 150 D1 | −21 |
| 23 (Comp.) | — | — | 100 ppm C1 | 150 D1 | −29 |
| 24 (Comp.) | — | — | 150 ppm C1 | 150 D1 | −31 |

TABLE 3-continued

| Cold flow improvement in test oil 2 | | | | | |
|---|---|---|---|---|---|
| | Additives | | | | Test oil 2 CFPP |
| Example | A | B | C | D | [° C.] |
| 25 (Comp.) | 50 A1 | — | 75 ppm C1 | 150 D1 | −14 |
| 26 (Comp.) | 50 A1 | — | 100 ppm C1 | 150 D1 | −19 |
| 27 (Comp.) | 50 A1 | — | 150 ppm C1 | 150 D1 | −20 |
| 28 (Comp.) | 50 A1 | — | 150 ppm C1 | 250 D1 | −20 |
| 29 | 50 A1 | 25 B1 | 75 ppm C1 | 150 D1 | −23 |
| 30 | 50 A1 | 25 B1 | 100 ppm C1 | 150 D1 | −30 |
| 31 | 50 A1 | 25 B1 | 150 ppm C1 | 150 D1 | −32 |
| 32 | 50 A1 | 25 B4 | 75 ppm C1 | 150 D1 | −19 |
| 33 | 50 A1 | 25 B4 | 100 ppm C1 | 150 D1 | −27 |
| 34 | 50 A1 | 25 B4 | 150 ppm C1 | 150 D1 | −30 |
| 35 (Comp.) | 50 A2 | — | 75 ppm C1 | 150 D1 | −15 |
| 36 (Comp.) | 50 A2 | — | 100 ppm C1 | 150 D1 | −12 |
| 37 (Comp.) | 50 A2 | — | 150 ppm C1 | 150 D1 | −20 |
| 38 (Comp.) | 50 A2 | — | 150 ppm C1 | 250 D1 | −21 |
| 39 | 50 A2 | 25 B1 | 75 ppm C1 | 150 D1 | −22 |
| 40 | 50 A2 | 25 B1 | 100 ppm C1 | 150 D1 | −28 |
| 41 | 50 A1 | 25 B1 | 150 ppm C1 | 150 D1 | −30 |

TABLE 4

| Cold flow improvement in test oil 3 | | | | | | | | |
|---|---|---|---|---|---|---|---|---|
| | | | | | Test oil 3 (CP −4, 4° C.) | | | |
| | Additives [ppm] | | | | CFPP | Sediment | Appearance | $CP_{cc}$ |
| Example | A | B | C | D | [° C.] | [% by vol.] | of oil phase | [° C.] |
| 42 (Comp.) | — | — | 400 C2 | 200 D1 | −20 | 2 | opaque | −3.1 |
| 43 (Comp.) | — | — | 535 C2 | 265 D1 | −22 | 2 | opaque | −3.2 |
| 44 (Comp.) | 40 A2 | — | 400 C2 | 200 D1 | −17 | 20 | cloudy | 0.2 |
| 45 (Comp.) | 40 A2 | — | 535 C2 | 265 D1 | −18 | 10 | cloudy | −1.2 |
| 46 | 40 A2 | 25 B1 | 400 C2 | 200 D1 | −21 | 2 | opaque | −3.3 |
| 47 | 40 A2 | 25 B1 | 535 C2 | 265 D1 | −24 | 2 | opaque | −2.9 |
| 48 | 40 A2 | 50 B1 | 400 C2 | 200 D1 | −22 | 2 | opaque | −3.0 |
| 49 | 40 A2 | 50 B1 | 535 C2 | 265 D1 | −24 | 2 | opaque | −2.9 |
| 50 | 40 A2 | 50 B2 | 400 C2 | 200 D1 | −21 | 0 | opaque | −1.4 |
| 51 | 40 A2 | 50 B2 | 535 C2 | 265 D1 | −22 | 0 | opaque | −2.3 |
| 52 | 40 A2 | 50 B4 | 400 C2 | 200 D1 | −19 | 4 | opaque | −2.4 |
| 53 | 40 A2 | 50 B4 | 535 C2 | 265 D1 | −21 | 3 | opaque | −3.2 |
| 54 (Comp.) | 50 A3 | — | 400 C2 | 200 D1 | −15 | 46 | clear | +2.4 |
| 55 (Comp.) | 50 A3 | — | 535 C2 | 265 D1 | −19 | 48 | clear | +1.6 |
| 56 | 50 A3 | 100 B1 | 400 C2 | 200 D1 | −30 | 0 | opaque | −2.4 |
| 57 | 50 A3 | 100 B1 | 535 C2 | 265 D1 | −21 | 0 | opaque | −3.1 |
| 58 | 50 A3 | 200 B1 | 400 C2 | 200 D1 | −22 | 0 | opaque | −3.1 |

TABLE 4-continued

| Cold flow improvement in test oil 3 | | | | | | | | |
|---|---|---|---|---|---|---|---|---|
| | | | | | Test oil 3 (CP −4, 4° C.) | | | |
| | Additives [ppm] | | | | CFPP | Sediment | Appearance | $CP_{cc}$ |
| Example | A | B | C | D | [° C.] | [% by vol.] | of oil phase | [° C.] |
| 59 | 50 A3 | 200 B4 | 400 C2 | 200 D1 | −19 | 4 | opaque | −0.1 |
| 60 | 50 A3 | 200 B4 | 535 C2 | 365 D1 | −20 | 2 | opaque | −1.6 |

TABLE 5

| Cold flow improvement in test oil 4 | | | | | |
|---|---|---|---|---|---|
| | Additives | | | | Test oil 4 CFPP |
| Example | A | B | C | D | [° C.] |
| 61 (Comp.) | — | — | 50 ppm C1 | — | −12 |
| 62 (Comp.) | — | — | 100 ppm C1 | — | −14 |
| 63 (Comp.) | — | — | 200 ppm C1 | — | −20 |
| 64 (Comp.) | 75 ppm A3 | — | 50 ppm C1 | — | −9 |
| 65 (Comp.) | 75 ppm A3 | — | 100 ppm C1 | — | −10 |
| 66 (Comp.) | 75 ppm A3 | — | 200 ppm C1 | — | −12 |
| 67 | 75 ppm A3 | 50 ppm B1 | 50 ppm C1 | — | −13 |
| 68 | 75 ppm A3 | 50 ppm B1 | 100 ppm C1 | — | −15 |
| 69 | 75 ppm A3 | 40 ppm B3 | 50 ppm C1 | — | −12 |
| 70 | 75 ppm A3 | 40 ppm B3 | 100 ppm C1 | — | −14 |
| 71 (Comp.) | — | — | 50 ppm C1 | 150 ppm D1 | −22 |
| 72 (Comp.) | — | — | 100 ppm C1 | 150 ppm D1 | −28 |
| 73 (Comp.) | — | — | 200 ppm C1 | 150 ppm D1 | −30 |
| 74 (Comp.) | 100 ppm A2 | — | 50 ppm C1 | 150 ppm D1 | −16 |
| 75 (Comp.) | 100 ppm A2 | — | 100 ppm C1 | 150 ppm D1 | −18 |
| 76 (Comp.) | 100 ppm A2 | — | 200 ppm C1 | 150 ppm D1 | −19 |
| 77 | 100 ppm A2 | 50 ppm B1 | 50 ppm C1 | 150 ppm D1 | −23 |
| 78 | 100 ppm A2 | 50 ppm B1 | 100 ppm C1 | 150 ppm D1 | −27 |
| 79 | 100 ppm A2 | 50 ppm B3 | 50 ppm C1 | 150 ppm D1 | −24 |
| 80 | 100 ppm A2 | 50 ppm B3 | 100 ppm C1 | 150 ppm D1 | −30 |
| 81 (Comp.) | — | — | 50 ppm C1 | 150 ppm D2 | −21 |
| 82 (Comp.) | — | — | 100 ppm C1 | 150 ppm D2 | −26 |
| 83 (Comp.) | — | — | 200 ppm C1 | 150 ppm D2 | −27 |
| 84 (Comp.) | 100 ppm A2 | — | 50 ppm C1 | 150 ppm D2 | −14 |
| 85 (Comp.) | 100 ppm A2 | — | 100 ppm C1 | 150 ppm D2 | −15 |
| 86 (Comp.) | 100 ppm A2 | — | 200 ppm C1 | 150 ppm D2 | −17 |
| 87 | 100 ppm A2 | 40 ppm B1 | 50 ppm C1 | 150 ppm D2 | −22 |
| 88 | 100 ppm A2 | 40 ppm B1 | 100 ppm C1 | 150 ppm D2 | −26 |
| 89 | 100 ppm A2 | 50 ppm B4 | 50 ppm C1 | 150 ppm D3 | −20 |
| 90 | 100 ppm A2 | 50 ppm B4 | 100 ppm C1 | 150 ppm D3 | −24 |

The experiments show that the impairment of cold flow properties, for example the CFPP value and the paraffin dispersancy of middle distillates additized with flow improvers, can be balanced out only by addition of the inventive polyoxyalkylene compounds. Higher dosage of the flow improver alone cannot achieve this result.

The invention claimed is:

1. A method for improving the response behavior of a mineral oil cold flow improver in a middle distillate, said method comprising adding to the middle distillate at least one oil-soluble polyoxyalkylene compound, this polyoxyalkylene compound being an oil-soluble ester, ether or ether/ester of alkoxylated polyols having at least three repeat alkoxy units derived from alkylene oxides having from 2 to 5 carbon atoms per OH group of the polyol which bears at least two aliphatic hydrocarbon radicals having from 12 to 30 carbon atoms, said mineral oil cold flow improver comprising at least one ashless, nitrogen-containing detergent additive which is an oil-soluble amphiphilic compound which comprises at least one alkyl or alkenyl radical which is bonded to a polar group, the alkyl or alkenyl radical comprising from 10 to 500 carbon atoms and the polar group comprising 2 or more nitrogen atoms.

2. The method of claim 1, wherein the middle distillate comprises more than 10 ppm of the at least one ashless, nitrogen-containing detergent additive.

3. The method of claim 1, wherein, based on one part by weight of the ashless nitrogen-containing detergent additive, from 0.01 to 10 parts by weight of the at least one oil-soluble polyoxyalkylene compound are used.

4. The method of claim 1, wherein the alkyl or alkenyl radical of the detergent additive is derived from oligomers of lower olefins having from 3 to 6 carbon atoms.

5. The method of claim 1, wherein the alkyl or alkenyl radical of the detergent additive comprises from 15 to 500 carbon atoms.

6. The method of claim 1, wherein the detergent additive derives from an alkenylsuccinic anhydride which has a degree of maleation, based on the proportions of the poly(olefins) reacted with unsaturated carboxylic acids, of, on average, more than one dicarboxylic acid unit per alkyl radical.

7. The method of claim 1, wherein the polar group of the detergent additives is derived from polyamines of the formula $$(R^9)_2N[A\text{-}N(R^9)]_q\text{—}(R^9)$$

where each $R^9$ is independently hydrogen, an alkyl or hydroxyalkyl radical having up to 24 carbon atoms, a polyoxyalkylene radical $\text{-}(A\text{-}O)_r\text{—}$ or polyiminoalkylene radical $\text{-}[A\text{-}N(R^9)]_s\text{—}(R^9)$, but at least $R^9$ is hydrogen, q is an integer from 1 to 19, A is an alkylene radical having from 1 to 6 carbon atoms, r and s are each independently an integer from 1 to 50.

8. The method of claim 1, wherein the polyamine from which the detergent additive derives contains structural elements derived from piperazine.

9. The method of claim 1, wherein the polyamine from which the detergent additive derives contains at least one primary amino group.

10. The method of claim 7, wherein the polyamine from which the detergent additive derives comprises more than 10% by weight of amines in which q is equal to 4 or greater than 4.

11. The method of claim 1, wherein the oil-soluble polyoxyalkylene compounds have at least 3 aliphatic hydrocarbon radicals.

12. The method of claim 1, where the oil-soluble polyoxyalkylene compounds are derived from polyols having 3 or more OH groups.

13. The method of claim 1, wherein the oil-soluble polyoxyalkylene compounds are esters, ethers and/or ether/esters in which less than 50 mol % of the fatty acids used for the esterification have double bonds.

14. The method of claim 1, wherein the cold flow improver comprises copolymers of ethylene and from 8 to 21 mol % of olefinically unsaturated compounds, the olefinically unsaturated compounds being one or more ester selected from the group consisting of vinyl esters, acrylic esters, methacrylic esters, alkyl vinyl ethers, alkenes, and mixtures thereof, each of which may be substituted by hydroxyl groups.

15. The method of claim 1, wherein the cold flow improver comprises an oil-soluble polar nitrogen compound which is a reaction product of an amine of the formula $NR^6R^7R^8$ where $R^6$, $R^7$ and $R^8$ may be the same or different, and at least one of these groups is $C_8$-$C_{36}$-alkyl, $C_6$-$C_{36}$-cycloalkyl, $C_8$-$C_{36}$-alkenyl, in particular $C_{12}$-$C_{24}$-alkyl, $C_{12}$-$C_{24}$-alkenyl or cyclohexyl, and the remaining groups are either hydrogen, $C_1$-$C_{36}$-alkyl, $C_2$-$C_{36}$-alkenyl, cyclohexyl, or a group of the formulae $\text{-}(A\text{-}O)_x\text{-}E$ or $\text{—}(CH_2)_n\text{—}NYZ$, where A is an ethyl or propyl group, x is from 1 to 50, E=H, $C_1$-$C_{30}$-alkyl, $C_5$-$C_{12}$-cycloalkyl or $C_6$-$C_{30}$-aryl, and n=2, 3 or 4, and Y and Z are each independently H, $C_1$-$C_{30}$-alkyl or $\text{-}(A\text{-}O)_x$, with compounds which contain an acyl group.

16. The method of claim 1, wherein the cold flow improver comprises an alkylphenol-formaldehyde resin which is an oligo- or a polymer having a repeat structural unit of the formula

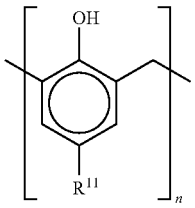

where $R^{11}$ is $C_1$-$C_{200}$-alkyl or -alkenyl, $O\text{—}R^{10}$ or $O\text{—}C(O)\text{—}R^{10}$, $R^{10}$ is $C_1$-$C_{200}$-alkyl or -alkenyl, and n is from 2 to 100.

17. The method of claim 1, wherein the cold flow improver comprises a comb polymer of the formula

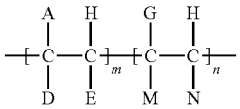

where

A is R', COOR', OCOR', R"—COOR', OR';

D is H, $CH_3$, A or R";

E is H, A;

G is H, R", R"—COOR', an aryl radical or a heterocyclic radical;

M is H, COOR", OCOR", OR", COOH;

N is H, R", COOR", OCOR, an aryl radical;

R' is a hydrocarbon chain having from 8 to 50 carbon atoms;

R" is a hydrocarbon chain having from 1 to 10 carbon atoms;

m is from 0.4 to 1.0; and n is from 0 to 0.6.

18. The method of claim 1, wherein the cold flow improver comprises a homo- or copolymer of an olefin which has from 2 to 30 carbon atoms and said homo- or copolymer has a molecular weight of up to 120 000 g/mol.

19. The method of claim 1, wherein the middle distillate has a sulfur content of less than 100 ppm and a distillation boiling range between 20 and 90% by volume of less than 120° C.

20. A composition comprising a) at least one ashless nitrogen-containing detergent additive which is an oil-soluble amphiphilic compound which comprises at least one alkyl or alkenyl radical which is bonded to a polar group, the alkyl or alkenyl radical comprising from 10 to 500 carbon atoms and the polar group comprising 2 or more nitrogen atoms, and b) an oil-soluble ester, ether or ether/ester of alkoxylated polyols having at least three repeat alkoxy units derived from alkylene oxides having from 2 to 5 carbon atoms per OH group of the polyol which bears at least two aliphatic hydrocarbon radicals having from 12 to 30 carbon atoms.

21. The composition as claimed in claim 20, comprising from 0.01 to 10 parts by weight of at least one oil-soluble polyoxyalkylene compound per part by weight of the ashless nitrogen-containing detergent additive.

22. The composition as claimed in claim 20, comprising from 5 to 90% by weight of constituents a) and b), and from 10 to 95% by weight of solvents.

23. The composition of claim 20, which comprises, based on one part by weight of the ashless nitrogen-containing detergent additive, from 0.01 to 10 parts by weight of at least one oil-soluble polyoxyalkylene compound.

24. The composition of claim 20, in which the alkyl or alkenyl radical of said detergent additive is derived from oligomers of lower olefins having from 3 to 6 carbon atoms.

25. The composition of claim 20, in which the alkyl or alkenyl radical of the detergent additive comprises from 15 to 500 carbon atoms.

26. The composition of claim 20, in which the detergent additive derives from an alkenylsuccinic anhydride which has a degree of maleation, based on the proportions of the poly (olefins) reacted with unsaturated carboxylic acids, of, on average, more than one dicarboxylic acid unit per alkyl radical.

27. The composition of claim 20, in which the polar group of the detergent additives is derived from polyamines of the formula $$(R^9)_2N\text{-}[A\text{-}N(R^9)]_q\text{—}(R^9)$$

where each $R^9$ is independently hydrogen, an alkyl or hydroxyalkyl radical having up to 24 carbon atoms, a polyoxyalkylene radical $\text{-}(A\text{-}O)_r\text{—}$ or polyiminoalkylene radical $\text{-}[A\text{-}N(R^9)]_s\text{—}(R^9)$, but at least $R^9$ is hydrogen, q is an integer from 1 to 19, A is an alkylene radical having from 1 to 6 carbon atoms, r and s are each independently an integer from 1 to 50.

28. The composition of claim 20, in which the polyamine from which the detergent additive derives contains structural elements derived from piperazine.

29. A middle distillate having a sulfur content of less than 100 ppm and a distillation boiling range between 20 and 90% by volume of less than 120° C., comprising from 10 to 10 000 ppm of the composition of claim 20 and at least one mineral oil cold flow improver.

30. The middle distillate as claimed in claim 29, comprising more than 10 ppm of at least one ashless nitrogen-containing detergent additive and, based on one part by weight of the ashless nitrogen-containing detergent additive, from 0.01 to 10 parts by weight of at least one oil-soluble polyoxyalkylene compound.

31. The middle distillate as claimed in claim 29, in which the mineral oil cold flow improver is selected from the group consisting of III) a copolymer of ethylene and from 8 to 21 mol % of an olefinically unsaturated compound, the olefinically unsaturated compound being selected from one or more vinyl esters, acrylic esters, methacrylic esters, alkyl vinyl ethers alkenes, each of which may be substituted by hydroxyl groups;

IV) an oil-soluble polar nitrogen compound which is a reaction product of an amine of the formula $NR^6R^7R^8$ where $R^6$, $R^7$ and $R^8$ may be the same or different, and at least one of these groups is $C_8$-$C_{36}$-alkyl, $C_6$-$C_{36}$-cycloalkyl, $C_8$-$C_{36}$-alkenyl, in particular $C_{12}$-$C_{24}$-alkyl, $C_{12}$-$C_{24}$-alkenyl or cyclohexyl, and the remaining groups are either hydrogen, $C_1$-$C_{36}$-alkyl, $C_2$-$C_{36}$-alkenyl, cyclohexyl, or a group of the formulae $\text{-}(A\text{-}O)_x\text{-}E$ or $\text{—}(CH_2)_n\text{—}NYZ$, where A is an ethyl or propyl group, x is from 1 to 50, E=H, $C_1$-$C_{30}$-alkyl, $C_5$-$C_{12}$-cycloalkyl or $C_6$-$C_{30}$-aryl, and n=2, 3 or 4, and Y and Z are each independently H, $C_1$-$C_{30}$-alkyl or $\text{-}(A\text{-}O)_x$, with compounds which contain an acyl group;

V) an alkylphenol-formaldehyde resin which are oligo- or polymers having a repeat structural unit of the formula

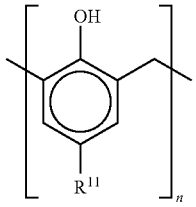

where $R^{11}$ is $C_1$-$C_{200}$-alkyl or -alkenyl, $O\text{—}R^{10}$ or $O\text{—}C(O)\text{—}R^{10}$, $R^{10}$ is $C_1$-$C_{200}$-alkyl or -alkenyl, and n is from 2 to 100;

VI) a comb polymer of the formula

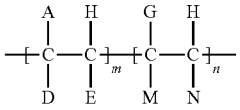

where

A is R', COOR', OCOR', R"—COOR', OR';

D is H, $CH_3$, A or R";

E is H, A;

G is H, R", R"—COOR', an aryl radical or a heterocyclic radical;

M is H, COOR", OCOR", OR", COOH;

N is H, R", COOR", OCOR, an aryl radical;

R' is a hydrocarbon chain having from 8 to 50 carbon atoms;

R" is a hydrocarbon chain having from 1 to 10 carbon atoms;

m is from 0.4 to 1.0; and n is from 0 to 0.6; and

VII) homo- and copolymers of olefins which have from 2 to 30 carbon atoms and molecular weights of up to 120 000 g/mol.

32. The middle distillate as claimed in claim 31, in which the mineral oil cold flow improver is a mixture of from 0.1 to 10 parts by weight of III) per part by weight of IV).

33. The middle distillate of claim 29, in which the weight ratio between the total content of ashless nitrogen-containing detergent additive and oil-soluble polyoxyalkylene compound on the one hand and the total content of mineral oil cold flow improvers as claimed in claim 31 on the other hand is between 10:1 and 1:10.

* * * * *